United States Patent [19]

Wintringham

[11] 4,327,144

[45] Apr. 27, 1982

[54] LUBRICATOR PAD AND METHOD

[75] Inventor: Henry J. Wintringham, Virginia Beach, Va.

[73] Assignee: Southland Manufacturing Co., Inc., Norfolk, Va.

[21] Appl. No.: 181,350

[22] Filed: Aug. 26, 1980

[51] Int. Cl.[3] ..... B32B 7/00; B32B 23/00; B05D 3/02

[52] U.S. Cl. ..... 428/264; 184/3 R; 252/14; 252/49.3; 252/52 A; 277/DIG. 6; 308/99; 427/324; 427/396; 428/289; 568/46

[58] Field of Search ..... 252/14, 49.3, 52 A; 568/46; 428/264, 289; 427/324, 396; 277/152, 208, DIG. 4, DIG. 6; 184/3 R; 308/99

[56] References Cited

U.S. PATENT DOCUMENTS

| | | | |
|---|---|---|---|
| 3,236,532 | 2/1966 | Sale et al. | 277/237 X |
| 3,871,837 | 3/1975 | Bedague et al. | 252/52 X |
| 3,919,097 | 11/1975 | Park | 252/52 X |
| 4,147,666 | 4/1979 | Michaelis et al. | 568/46 X |

*Primary Examiner*—Michael R. Lusignan
*Attorney, Agent, or Firm*—Mason, Fenwick & Lawrence

[57] ABSTRACT

Cotton wicking material for use in railway journal pads is washed, soaked in a warm solution of polyethylene glycol tertdodecyl thioether and slowly dried to greatly reduce its ability to conduct water by capillary action.

17 Claims, 1 Drawing Figure

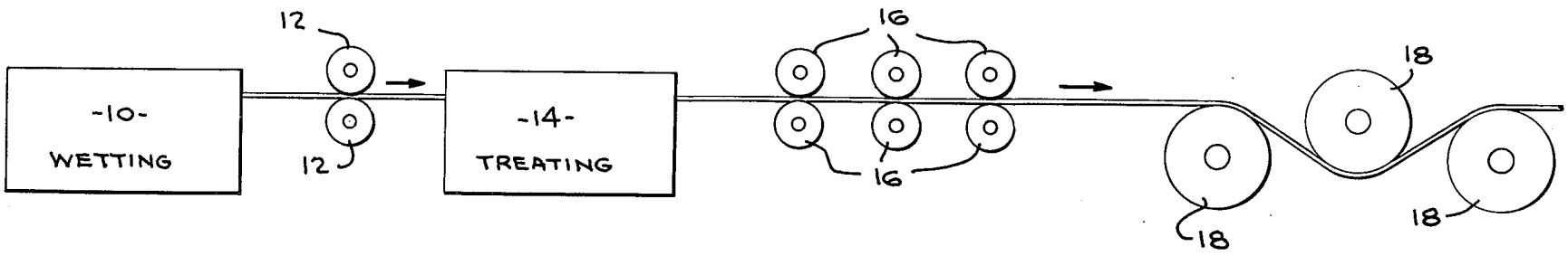
-10-
WETTING
12
12
-14-
TREATING
16
16
18
18
18

LUBRICATOR PAD AND METHOD

BACKGROUND OF THE INVENTION

The present invention relates to the field of lubricator pads and the like relying upon wicking action for conveying fluid to an area to be lubricated. More specifically, the present invention is directed to a method of treating wicking material employed in lubricating pads used for lubricating journal boxes of railway freight cars and is even more specifically directed to a method of treating the wicking material so as to impair its ability to wick (convey by capillary action) water without impairing its ability to wick lubricating material.

Railway journal boxes of well-known conventional design such as shown in U.S. Pat. No. 3,236,532 include an arcuate brass journal which rests on the upper periphery of the axle with the lower portion of the journal box including a sump containing a quantity of lubricant which must be conveyed to the axle in order to reduce friction and prevent the well-known "hot-box" resultant from the failure to provide adequate lubrication to the journal and axle. Lubricator pads such as shown in prior U.S. Pat. Nos. 2,992,051 and 3,347,606 have been used for a number of years to alleviate the "hot box" problem; such pads are positioned in the sump of the journal box with their upper end engaging the axle for conveying lubricant by capillary action upwardly to the axle in a wellknown manner. However, the operational presence of water in the journal box, as frequently occurs, can create substantial operational problems since the wicking material tends to wick the water upwardly to the axle with a consequent reduction in the amount of lubricant that can be conveyed to the axle by the wicking material. Also, the presence of substantial quantities of water in the journal box can cause the oil to flow upwardly out of the journal box so that all that remains in the sump is a body of water with a thin skim of oil floating on its upper surface. Unfortunately, the occurrence of the foregoing circumstances is difficult to detect due to the fact that the water with the skim of oil on its upper surface is practically identical in appearance to pure oil and the observer will frequently be deceived into believing the sump to be full of oil.

Moreover, water in the journal box can create even greater problems during cold weather when the water freezes and practically completely impairs the conveyance of lubricant to the axle areas.

Another cold weather problem arises when water on the upper portion of the lubricator pad freezes to adhere the upper end of the lubricator pad to the journal surface of the axle so that subsequent rotation of the axle causes the lubricator pad to be rotated in the journal box so as to substantially lift it from the lubricant in the sump and/or to damage the lubricator pad in a variety of ways. Additionally, the presence of water in the journal box is deleterious even in warm climates since it creates etching and pitting of the journal surface of the axle.

The foregoing resultant from the presence of water in the journal boxes of railway cars have resulted in numerous attempted solutions all based on prevention of the entry of water into the journal box; however; water can enter the journal box in a variety of ways, such as rain, melting snow, drainage from the side of the car and condensation, and the avoidance of water in the sump has not been possible and solutions to problems resultant from such presence has not been achieved.

Thus, the present invention is resultant from the realization that the avoidance of water presence is journal boxes is practically impossible and the further realization that if the lubricator pad did not wick the water in the journal box, a substantial amount of the problems resultant from water presence would be avoided.

Therefore it is the primary object of this invention to provide a new and improved lubricator pad for railway journal boxes.

Another object of the present invention is the provision of a new and improved method of treating wicking materials such as are used in railway journal box lubricator pads so as to impair the tendency of such material to convey water by capillary action.

Achievement of the foregoing objects is enabled by preferred embodiment through the provision of a method of treating the cotton fabric wicking material by first soaking such cloth material in water at approximately 180° F., squeezing the water from the cloth, immersing the cloth in a 5% solution of polyethylene glycol tertdodecyl thioether in water and then squeezing the excess liquid from the cloth. The cloth is then permitted to dry as it passes over heated rolls. Upon completion of the foregoing procedures, the cloth has a unique characteristic in that it tends to reject water while still having the capability of conveying lubricant by capillary action. In an alternative method, the cloth is dried by air flow which sets the solution into the fibers to provide the resultant desired characteristic of impaired water wicking capability.

DESCRIPTION OF THE FIGURE

The FIGURE is a flow diagram illustrating the steps in practice of the inventive method.

DESCRIPTION OF THE PREFERRED EMBODIMENT

In a first example of the inventive method, wicking material in the form of cotton fabric woven with a wrap thread of 6 count, 2 ply, is formed with a very light tension so as not crush the cotton fiber. Filler or pick threads are formed of 8 count, 4 ply, also with light tension. The resulting yarn is then woven into a 2 ply fabric having no stuffer (filling) threads and is bound together by the pick and pick method which uses two shuttles of pick threads alternately passing through the warp threads thus reducing tension and crushing of the fibers. It is essential that none of the yarn or the fabric formed therefrom be scoured or bleached in any manner.

Fabric formed in the foregoing manner is then positioned in a wetting and heating tank 10 containing a body of water at approximately 180° F. The body of cloth is then removed from the wetting tank 10 and passed through squeeze rolls 12 which remove water from the fabric. The cloth then passes into a treating tank 14 in which a quantity of treating liquid is provided. The treating liquic comprises a 5% solution of polyethylene glycol tertdodecyl thioether (hereinafter referred to as PGTT) in water which is maintained at approximately 180° F. The fabric from the treating tank 14 is then passed through three sets of squeeze rolls 16 which squeeze approximately 50% of the liquid therefrom. The cloth then passes over drying rolls 18 maintained at a temperature of approximately 150° F. to slowly dry the fabric and set the solution into the fibers.

A small amount of solution apparently remains in the fabric fibers.

Cloth treated in the foregoing manner is then used to fabricate a conventional lubricator pad such as those shown in the aforementioned U.S. Pat. Nos. 2,992,051 and 3,347,606. Such lubricator pads have been found to be extremely effective in rejecting the wicking of water while still maintaining the ability to wick lubricant to the axle areas of a railway journal box. The manner in which the treating solution achieves the foregoing results is not understood, particularly in view of the fact that PGTT when used in other different processes acts in an exact reverse manner as a wetting agent. However, it is thought that the PGTT somehow effects a molecular change in the molecules of the fabric to result in a great lessening in the ability of the fabric to convey water by capillary action. (wicking).

It has also been found that the same satisfactory results can be achieved when the cloth is dried by low volume air flow at a temperature of approximately 200° rather than by passing the cloth over the drying rollers 18.

One possible explanation of the manner in which the invention functions is that a small quantity of the PGTT coats the individual cotton fibers which were in the form of hollow cylinders open at both ends so that surfaces of the fibers attract oil while they repel water. The weave construction of the fabric permits the syphon action on the oil to effect the transfer of oil up the length of the woven fibers to the area desired to be lubricated.

Numerous modifications of the inventive method will undoubtedly occur to those of skill in the art, for example, the method is not limited to the particular cloth weave construction disclosed herein; it should therefore be understood that the spirit and scope of the invention is to be limited solely by the appended claims.

I claim:

1. A method of treating cloth wicking material for use in a lubricator pad to reduce the tendency of said cloth wicking material to wick water without impairing its ability to wick lubricant, said method comprising the sequential steps of:

(1) wetting a body of cloth wicking material;

(2) soaking said body of cloth wicking material in an aqueous treating solution containing polyethylene glycol tertdodecyl thioether; and (3) slowly drying said body of cloth wicking material.

2. The method of claim 1 wherein step (1) is effected by immersion of said body of cloth in a body of water at about 180° F.

3. The method of claim 1 wherein step (1) is effected by immerson of said body of cloth in a body of water at about 180° F. and including the further step of agitating said body of water while said body of cloth wicking material is immersed therein.

4. The method of either of claims 1, 2 or 3 wherein said aqueous treating solution is a 5% solution of polyethylene glycol tertdodecyl thioether.

5. The method of claim 1, wherein step (3) is effected in a drying chamber at a temperature of about 200° F.

6. The method of claim 5, wherein step (1) is effected by immersion of said body of cloth in a body of water at a temperature of approximately 180° F.

7. The method of claim 5, wherein step (1) is carried out by immersion of said body of cloth in water at about 180° F. and including the further step of agitating said water while said cloth is immersed therein.

8. The method of claim 7 wherein said aqueous treating solution is a 5% solution of polyethylene glycol tertdodecyl thioether.

9. A body of cloth wicking material treated by the method of claim 1.

10. A body of cloth wicking material treated by the method of claim 8.

11. A railway car journal lubricator pad comprising a body of fibrous wicking material having the fibers thereof superficially coated with polyethylene glycol tertdodecyl thioether and exhibiting a reduced wicking capability for water with unimpaired wicking capability for lubricating oil.

12. In a lubrication system for an axle of railroad rolling stock or the like wherein the axle is journaled in a journal box having a well therein which is adapted to contain lubricating oil for the axle and a mass of fibrous material is disposed within said well to make contact with a portion of the periphery of the axle and transfer said lubricating oil from said well to said axle by wicking through said fibrous material, in combination, the improvement wherein the fibers in said mass are superficially coated with a polyethylene glycol tertdodecyl thioether, whereby the capability of said fibrous material for wicking water incidentally introduced into said well during use of said rolling stock is reduced while its capability for wicking said lubricating oil is retained.

13. The system of claim 12 wherein said mass of fibrous material is comprised of a loosely woven fabric of staple fiber yarns.

14. The system of claim 13 wherein said staple fiber yarns are cotton yarns.

15. In a method of lubricating the axles of railroad rolling stock and the like in which each said axle is journaled in a journal box having a well and lubricating oil is applied to the axle from said well by wicking through a mass of fibrous material disposed within said well in contact with a portion of the axle periphery, the improvement wherein said mass of fibrous material is superficially impregnated with a polyethylene glycol tertdodecyl thioether, whereby the capability of said fibrous material for wicking water incidentally introduced into said well during use of said rolling stock is reduced while its capability for wicking said lubricating oil is retained.

16. The method of claim 15 wherein said mass of fibrous material is comprised of a loosely woven fabric of staple fiber yarns.

17. The method of claim 16 wherein said staple fiber yarns are cotton yarns.

* * * * *